US008820859B1

(12) United States Patent
Kim

(10) Patent No.: US 8,820,859 B1
(45) Date of Patent: Sep. 2, 2014

(54) AIR INTAKE IN ICE CREAM DIPPING CABINET

(71) Applicant: Brian S. Kim, Rancho Palos Verdes, CA (US)

(72) Inventor: Brian S. Kim, Rancho Palos Verdes, CA (US)

( * ) Notice: Subject to any disclaimer, the term of this patent is extended or adjusted under 35 U.S.C. 154(b) by 0 days.

(21) Appl. No.: 13/786,204

(22) Filed: Mar. 5, 2013

(51) Int. Cl.
*A47F 3/04* (2006.01)

(52) U.S. Cl.
USPC ..... 312/116

(58) Field of Classification Search
USPC ..... 312/31, 31.01, 36, 116, 138.1, 401, 312/236; 62/246, 255, 456
See application file for complete search history.

(56) References Cited

U.S. PATENT DOCUMENTS 2,706,387 A * 4/1955 Swanson ..... 62/248
2,807,154 A * 9/1957 Hilding et al. ..... 62/259.1
2,932,955 A * 4/1960 Hargrave et al. ..... 62/255
2,961,851 A * 11/1960 Ehrenfreund ..... 62/448
3,218,822 A * 11/1965 Bently et al. ..... 62/256
3,740,735 A * 6/1973 Gabor ..... 360/99.13
3,759,059 A * 9/1973 Kenyon ..... 62/246

* cited by examiner

*Primary Examiner* — Matthew Ing
(74) *Attorney, Agent, or Firm* — John K. Park; Park Law Firm

(57) ABSTRACT

An ice cream dipping cabinet includes a cabinet portion, a machine room portion, a cooling room portion, a hot-air vent, a L-shaped recess portion, and a cold-air intake. The cabinet portion provides an inner compartment. The machine room portion is installed in a lower portion of the inner compartment of the cabinet portion. The cooling room portion is cooled by refrigeration and accessible through the top opening. The hot-air vent is provided through the rear wall of the cabinet portion, and the hot-air vent vents hot air from the machine room portion to outside. The L-shaped recess portion is provided between the front wall and the bottom floor of the cabinet portion, and the L-shaped recess portion comprises a horizontal surface and a vertical surface. The cold-air intake is provided through the L-shaped recess portion, and the cold-air intake guides cold air from outside to the machine room portion.

11 Claims, 8 Drawing Sheets

AIR INTAKE IN ICE CREAM DIPPING CABINET

BACKGROUND OF THE INVENTION

The present invention relates to an air intake in ice cream dipping cabinet. More particularly, this invention relates to an air intake in ice cream dipping cabinet, which facilitates cooling of the refrigerator.

Accordingly, a need for an air intake in ice cream dipping cabinet has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide an air intake in ice cream dipping cabinet.

An aspect of the invention provide an ice cream dipping cabinet, which comprises a cabinet portion, a machine room portion, a cooling room portion, a hot-air vent, a L-shaped recess portion, and a cold-air intake.

The cabinet portion has a front wall, a rear wall, two side walls, a bottom floor, and a top opening, and the cabinet portion provides an inner compartment enclosed by the front, rear, and side walls and the bottom floor is connected to the top opening.

The machine room portion is installed in a lower portion of the inner compartment of the cabinet portion, and the machine room portion is configured to receive parts for a refrigerator.

The cooling room portion is installed in an upper portion of the inner compartment of the cabinet portion, and the cooling room portion is configured to be cooled by refrigeration and accessible through the top opening.

The hot-air vent is provided through the rear wall of the cabinet portion, and the hot-air vent is configured to vent hot air from the machine room portion to outside.

The L-shaped recess portion is provided between the front wall and the bottom floor of the cabinet portion, and the L-shaped recess portion comprises a horizontal surface and a vertical surface.

The cold-air intake is provided through the L-shaped recess portion, and the cold-air intake is configured to guide cold air from outside to the compressor.

The cold-air intake may be disposed lower than the hot-air vent.

A height-distance of the horizontal surface of the L-shaped recess portion from the bottom floor and the depth-distance of the vertical surface of the L-shaped recess portion from the front wall may be configured such that the cold-air intake disposed through the vertical surface are hidden from an observer standing away by a predetermined distance from the ice cream dipping cabinet.

The cold-air intake may comprise a plurality of first parallel slits installed on the horizontal surface of the L-shaped recess portion, and each of plurality of first parallel slits may extend from the front wall to the rear wall.

The cold-air intake may further comprise a plurality of second parallel slits installed on the vertical surface of the L-shaped recess portion, and each of plurality of second parallel slits may extend vertically.

The height-distance of the horizontal surface of the L-shaped recess portion from the bottom floor may be smaller than the depth-distance of the vertical surface of the L-shaped recess portion from the front wall.

The plurality of first or second parallel slits may be disposed on a part of the horizontal or vertical surfaces of the L-shaped recess portion, respectively.

The height-distance of the horizontal surface of the L-shaped recess portion from the bottom floor may be larger than the depth-distance of the vertical surface of the L-shaped recess portion from the front wall.

The hot-air vent may be configured to blow the hot air rearward.

The cold-air intake may be configured to receive the cold air from the front side of the ice cream cabinet.

The hot-air vent and the cold-air intake may be disposed so as to prevent the hot air out of the hot-air vent from re-entering through the cold-air intake.

The cold-air intake may be disposed lower than the hot-air vent.

The advantages of the present invention are: (1) the air intake can provide an efficient system for cooling a compressor in a refrigerator; and (2) the air intake is provided to prevent hot air from the compressor from re-entering the refrigerator.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

FIGS. 1-7 show an ice cream dipping cabinet according to embodiments of the invention.

Figure 1:
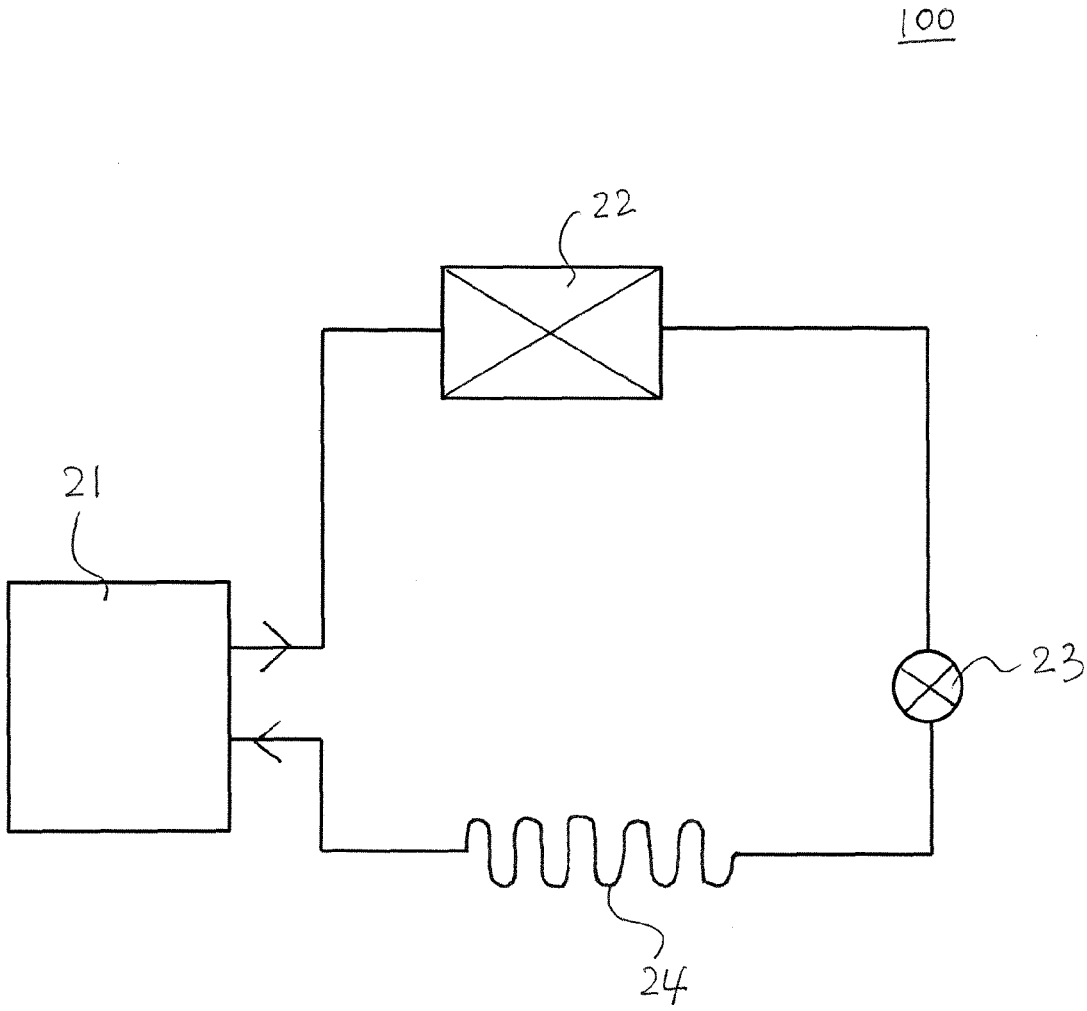
FIG. 1 is a schematic block diagram of an ice cream dipping cabinet according to the invention.
Figure 5:
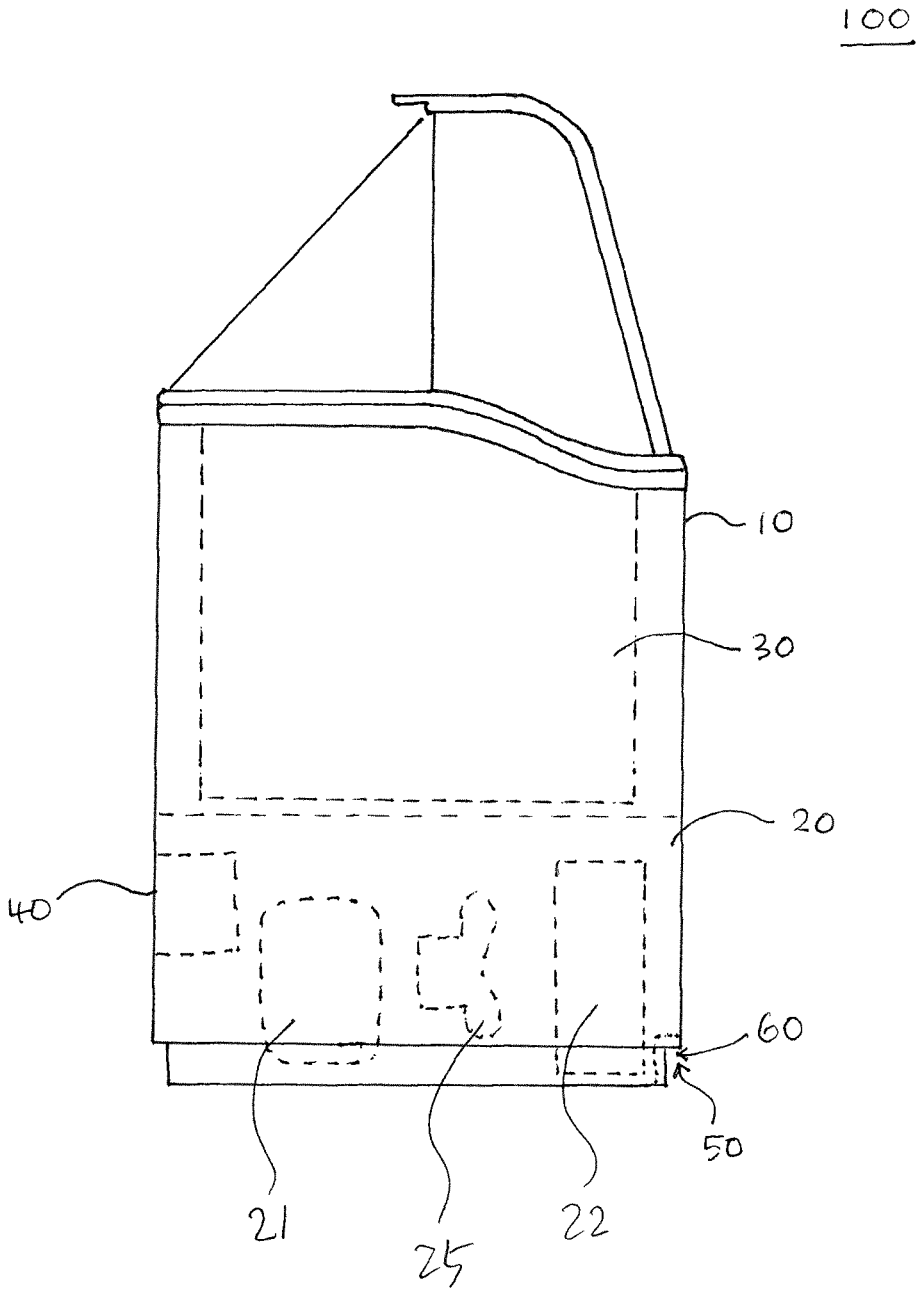
FIG. 5 is another side view of an ice cream dipping cabinet with parts in dash line according to an embodiment of the invention.
Figure 6:
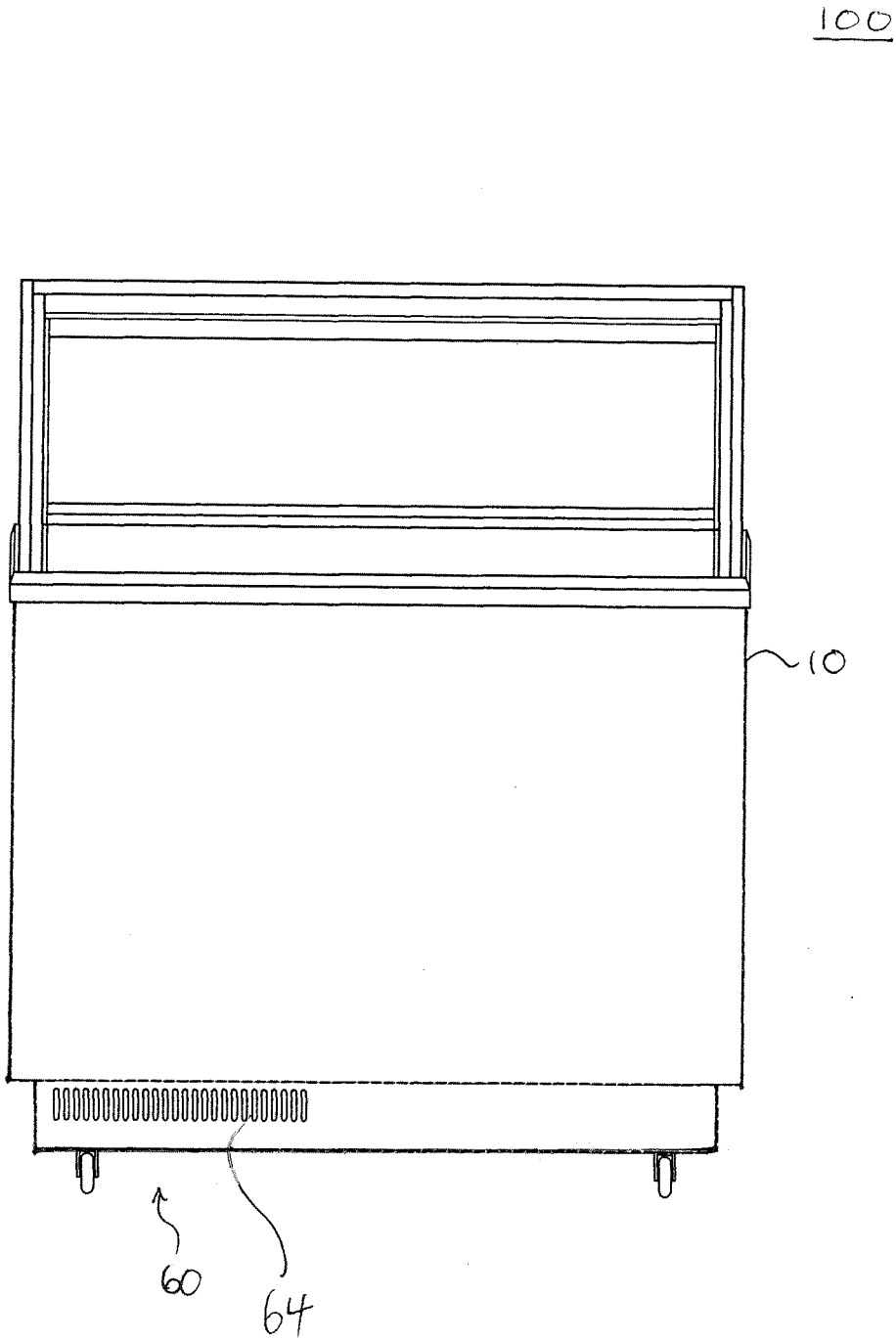
FIG. 6 is a front view of the ice cream dipping cabinet in FIG. 2.

FIG. 1 shows a schematic block diagram of an ice cream dipping cabinet 100 according to the invention, which includes a compressor 21, a condenser coil 22, a capillary tube 23, and an evaporator coil 24, and FIG. 5 shows a condenser fan motor and blade 25 additionally.

Figure 2:
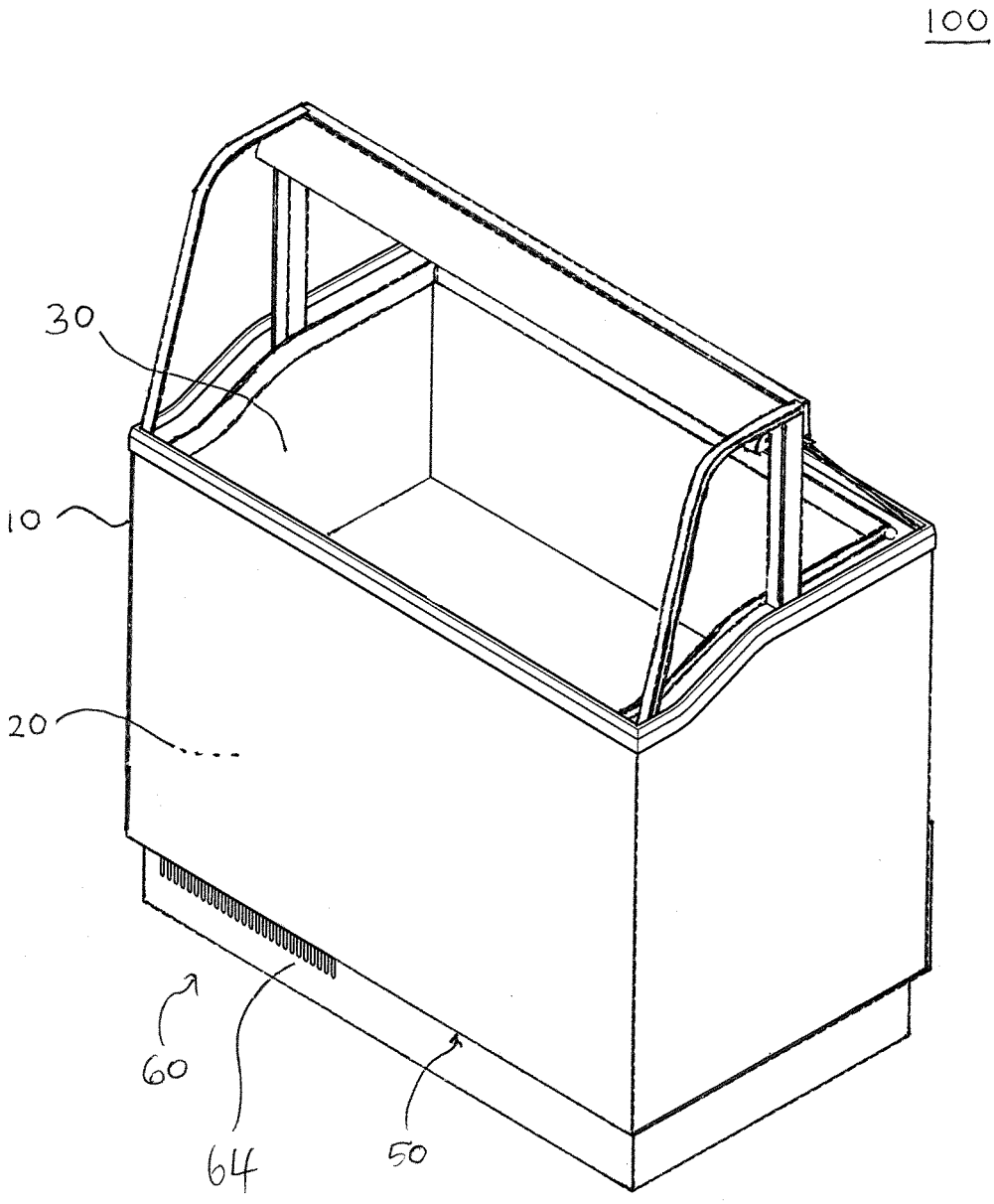
FIG. 2 is a perspective front view of an ice cream dipping cabinet according to an embodiment of the invention.
Figure 3:
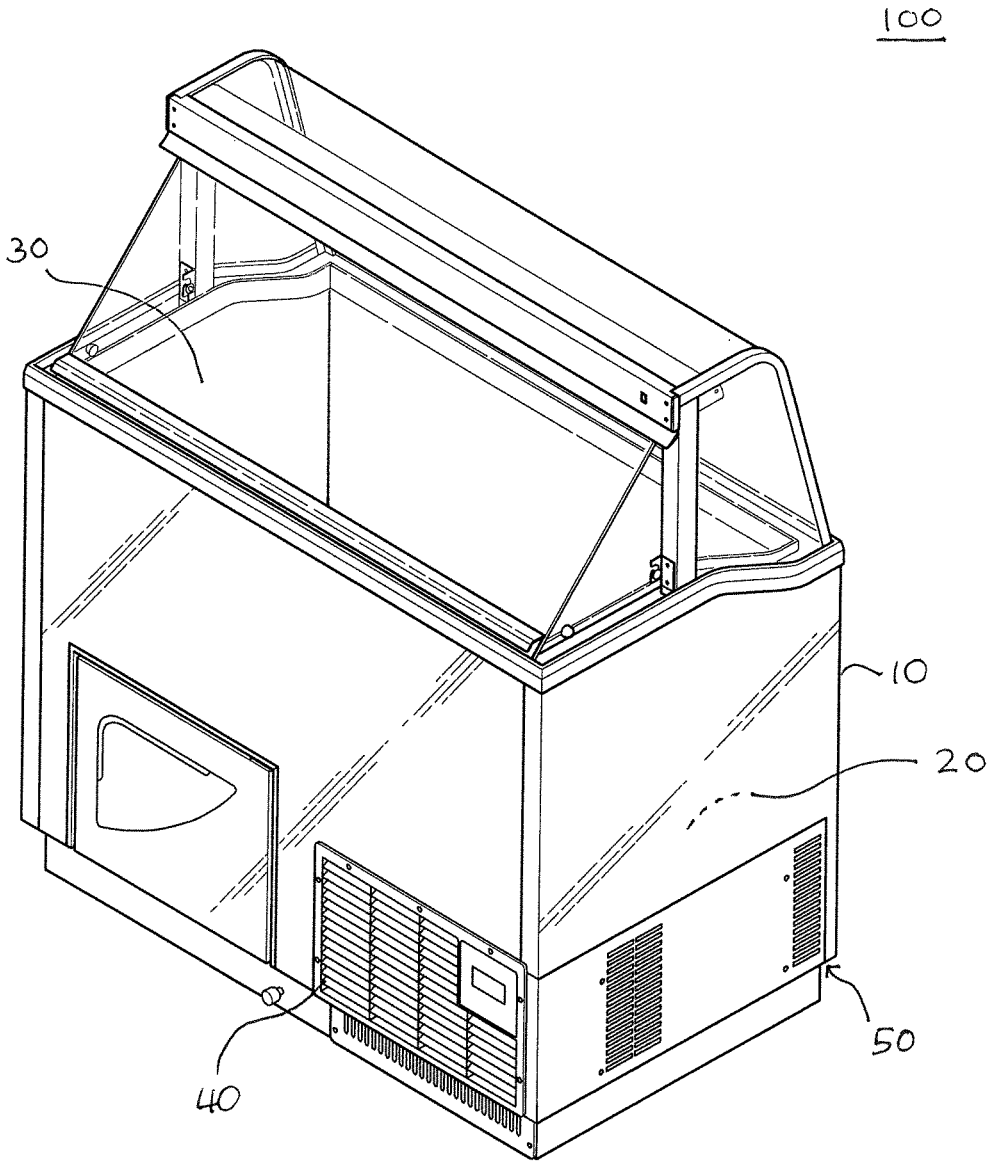
FIG. 3 is a perspective rear view of the ice cream dipping cabinet in FIG. 2.
Figure 4:
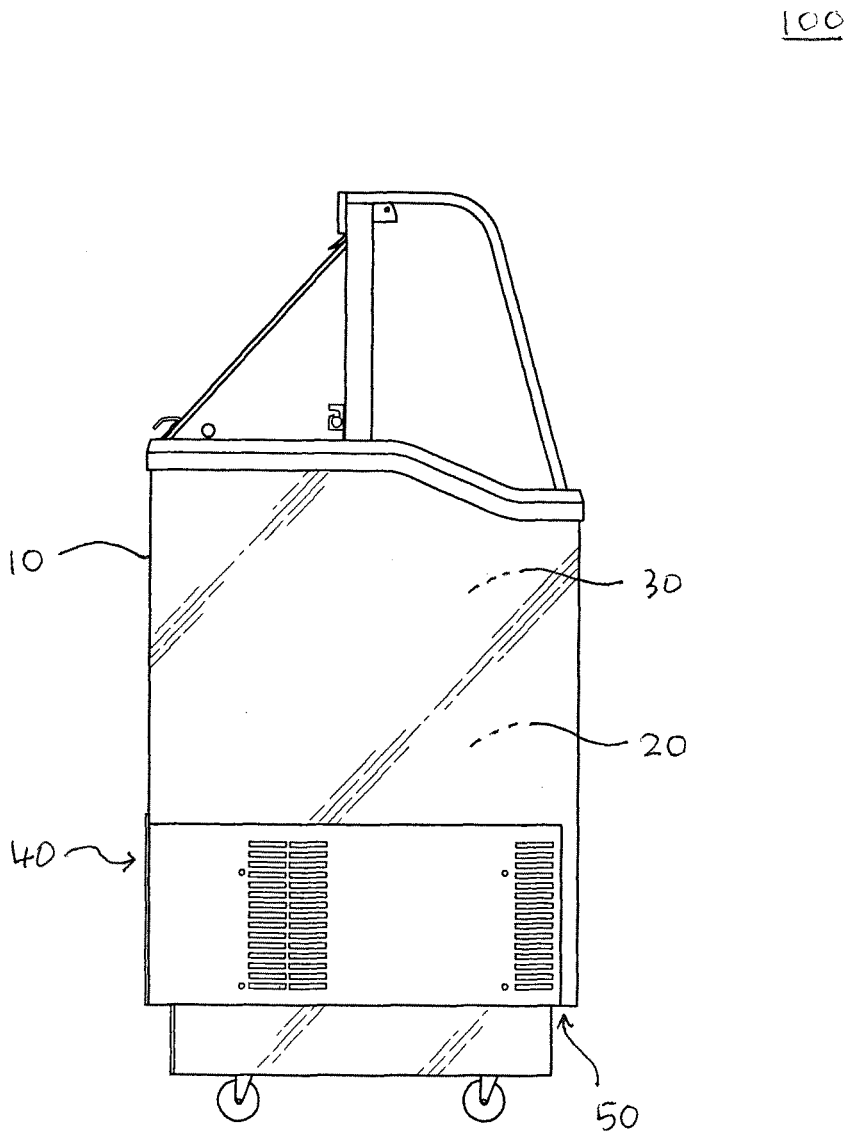
FIG. 4 is a side view of the ice cream dipping cabinet in FIG. 2.

An aspect of the invention shown in FIGS. 2-7 provide an ice cream dipping cabinet 100, which comprises a cabinet portion 10, a machine room portion 20, a cooling room portion 30, a hot-air vent 40, a L-shaped recess portion 50, and a cold-air intake 60 as shown in FIGS. 2 and 3.

The cabinet portion 10 has a front wall, a rear wall, two side walls, a bottom floor, and a top opening, and the cabinet portion 10 provides an inner compartment enclosed by the front, rear, and side walls and the bottom floor is connected to the top opening, where the parts can be located clearly and self-evidently in the figures.

The machine room portion 20 is installed in a lower portion of the inner compartment of the cabinet portion 10, and the machine room portion 20 is configured to receive parts for refrigerating operation such as the compressor 21, the condenser coil 22, the capillary tube 23, and the evaporator coil 24 as described in FIG. 1.

The cooling room portion 30 is installed in an upper portion of the inner compartment of the cabinet portion 10, and the cooling room portion 30 is configured to be cooled by refrigeration through the parts in the machine room portion 20 and accessible through the top opening as shown in FIGS. 2-5.

The hot-air vent 40 is provided through the rear wall of the cabinet portion 10, and the hot-air vent 40 is configured to vent hot air from the machine room portion 20 to outside. As well known in the prior arts, the process of condensation of refrigerant emits heat which was taken from the cooling room portion 30 through the evaporator coil 24. This heat or the hot air heated by the heat should be removed from inside of the machine room portion 20 for efficient function of the ice cream dipping cabinet 100.

Figure 7:
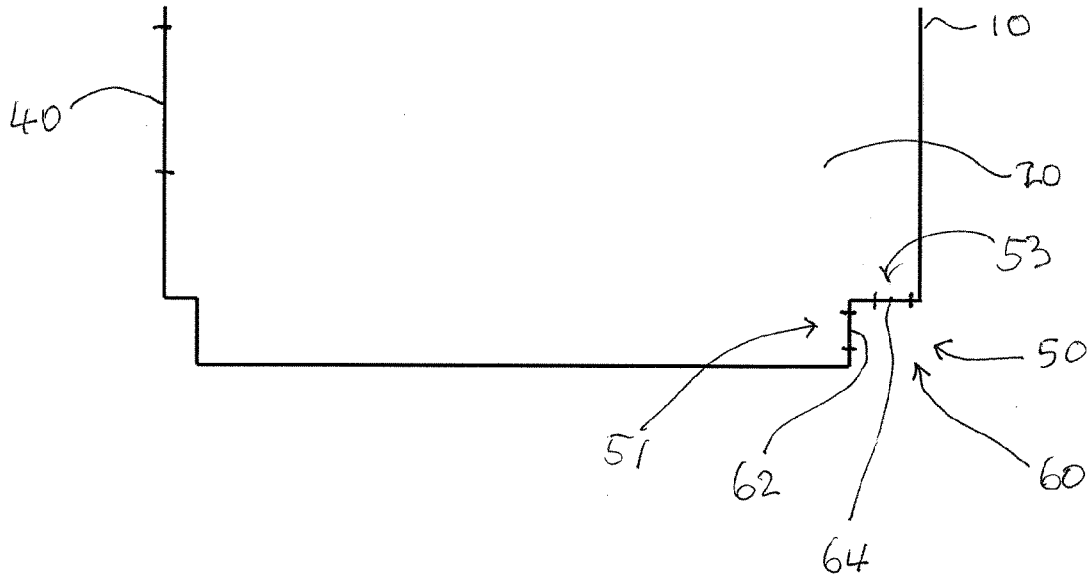
FIG. 7 is a partial side cross-sectional view of an ice cream dipping cabinet with a hot-air vent and a cold-air intake according to an embodiment of the invention.

The L-shaped recess portion 50 is provided between the front wall and the bottom floor of the cabinet portion 10, and the L-shaped recess portion 50 comprises a horizontal surface 53 and a vertical surface 51 as shown in FIG. 7.

The cold-air intake 60 is provided through the L-shaped recess portion 50, and the cold-air intake 60 is configured to guide cold air from outside to the machine room portion 20.

The cold-air intake 60 may be disposed lower than the hot-air vent 40 as shown in FIG. 7. That way, the hot air arises further so as to minimize the chance to mingle with cold air, which might be taken in through the cold-air intake 50.

Figure 8:
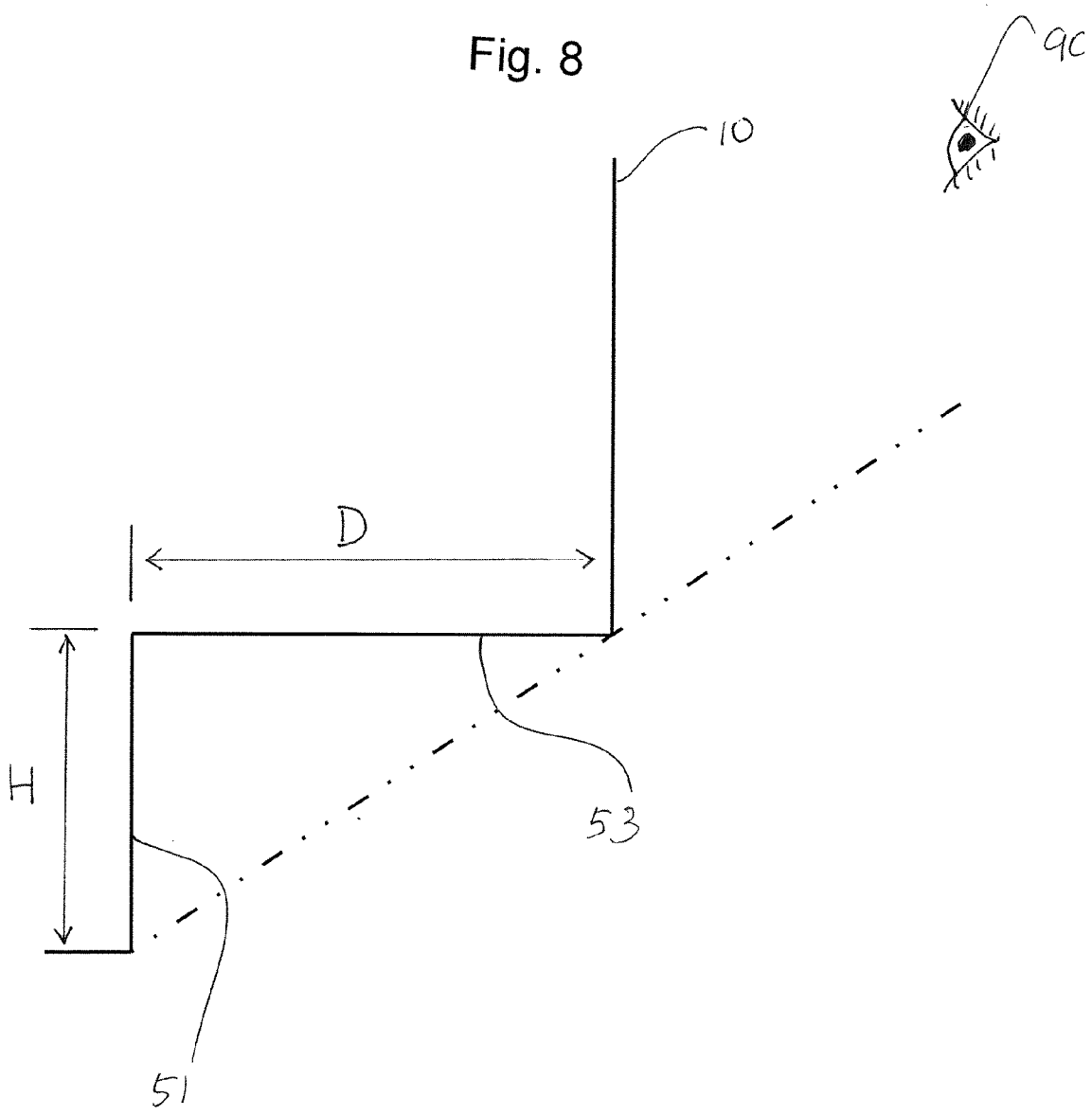
FIG. 8 is a partial enlarged view of a L-shaped recess portion according to an embodiment of the invention

A height-distance H of the horizontal surface 53 of the L-shaped recess portion 50 from the bottom floor and the depth-distance D of the vertical surface 51 of the L-shaped recess portion 50 from the front wall may be configured such that the cold-air intake 62 disposed through the vertical surface 61 are hidden from an observer 90 standing away within a predetermined distance from the ice cream dipping cabinet 100 as shown in FIG. 8.

The cold-air intake 60 may comprise a plurality of first parallel slits 64 installed on the horizontal surface 53 of the L-shaped recess portion 50, and each of plurality of first parallel slits 64 may extend from the front wall to the rear wall as shown in FIG. 7.

The cold-air intake 60 may further comprise a plurality of second parallel slits 62 installed on the vertical surface of the L-shaped recess portion 50, and each of plurality of second parallel slits 62 may extend vertically as shown in FIGS. 2 and 7.

The height-distance H of the horizontal surface 53 of the L-shaped recess portion 50 from the bottom floor may be smaller than the depth-distance D of the vertical surface 51 of the L-shaped recess portion 50 from the front wall as shown in FIG. 8.

The plurality of first or second parallel slits may be disposed on a part of the horizontal or vertical surfaces of the L-shaped recess portion, respectively.

The height-distance H of the horizontal surface 53 of the L-shaped recess portion 50 from the bottom floor may be larger than the depth-distance D of the vertical surface 51 of the L-shaped recess portion 50 from the front wall contrary to FIG. 8. Still the vertical surface 51 may be configured to be invisible to the observer 90 within another predetermined distance from the front wall.

The hot-air vent 40 may be configured to blow the hot air rearward, away from the cold-air intake 60, even in the opposite side.

The cold-air intake 60 may be configured to receive the cold air from the front side of the ice cream cabinet 100.

The hot-air vent 40 and the cold-air intake 60 may be disposed so as to prevent the hot air out of the hot-air vent 40 from re-entering through the cold-air intake 60. The claimed structure of them makes it sure actually.

The cold-air intake 60 may be disposed lower than the hot-air vent 40.

Usually in conventional ice cream dipping cabinet or refrigerator, a cold-air intake has been disposed to hide it from the view sight of users.

Therefore, the cold-air intake cannot help but being disposed on a same plane, for example, a rear panel of the refrigerator.

However, such an installment makes the cold-air intake too close to a hot-air vent, which unmistakably hot air from the hot-air vent is routed into the cold-air intake, so that the hot air from inside is forced to reenter the refrigerator.

In the present invention, since the cold-air intake 60 is disposed on the front of the ice cream dipping cabinet 100, the hot air out of the machine room portion 20 is blown rearward and the cold air to be introduced into the machine room portion 20 is taken from the front space, which is opposite to where the hot air is.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. An ice cream dipping cabinet comprising:

a cabinet portion having a front wall, a rear wall, two side walls, a bottom floor, and a top opening, wherein the cabinet portion provides an inner compartment enclosed by the front, rear, and side walls and the bottom floor is connected to the top opening;

a machine room portion installed in a lower portion of the inner compartment of the cabinet portion, wherein the machine room portion is configured to receive parts of a refrigerator;

a cooling room portion installed in an upper portion of the inner compartment of the cabinet portion, wherein the cooling room portion is configured to be cooled by refrigeration and accessible through the top opening;

a hot-air vent provided through the rear wall of the cabinet portion, wherein the hot-air vent is configured to vent hot air from the machine room portion to outside;

a L-shaped recess portion provided along an edge between the front wall and the bottom floor of the cabinet portion, wherein the L-shaped recess portion comprises a horizontal surface and a vertical surface; and a cold-air intake provided through the horizontal and vertical surfaces of the L-shaped recess portion, wherein the cold-air intake is configured to guide cold air from outside to the machine room portion, wherein a height-distance of the horizontal surface of the L-shaped recess portion from the bottom floor and the depth-distance of the vertical surface of the L-shaped recess portion from the front wall are configured such that the cold-air intake disposed through the vertical surface are hidden from an observer standing away by a predetermined distance from the ice cream dipping cabinet.

2. The ice cream dipping cabinet of claim 1, wherein the cold-air intake is disposed lower than the hot-air vent.

3. The ice cream dipping cabinet of claim 1, wherein the cold-air intake comprises a plurality of first parallel slits installed on the horizontal surface of the L-shaped recess portion, wherein each of plurality of first parallel slits extends from the front wall to the rear wall.

4. The ice cream dipping cabinet of claim 3, wherein the cold-air intake further comprises a plurality of second parallel slits installed on the vertical surface of the L-shaped recess portion, wherein each of plurality of second parallel slits extends vertically.

5. The ice cream dipping cabinet of claim 4, wherein the height-distance of the horizontal surface of the L-shaped recess portion from the bottom floor is smaller than the depth-distance of the vertical surface of the L-shaped recess portion from the front wall.

6. The ice cream dipping cabinet of claim 5, wherein the plurality of first or second parallel slits are disposed on a part of the horizontal or vertical surfaces of the L-shaped recess portion, respectively.

7. The ice cream dipping cabinet of claim 3, wherein the height-distance of the horizontal surface of the L-shaped recess portion from the bottom floor is larger than the depth-distance of the vertical surface of the L-shaped recess portion from the front wall.

8. The ice cream dipping cabinet of claim 1, wherein the hot-air vent is configured to blow the hot air rearward.

9. The ice cream dipping cabinet of claim 8, wherein the cold-air intake is configured to receive the cold air from the front side of the ice cream cabinet.

10. The ice cream dipping cabinet of claim 9, wherein the hot-air vent and the cold-air intake are disposed so as to prevent the hot air out of the hot-air vent from re-entering through the cold-air intake.

11. The ice cream dipping cabinet of claim 10, wherein the cold-air intake is disposed lower than the hot-air vent.

* * * * *